US008708718B2

(12) United States Patent
Li et al.

(10) Patent No.: US 8,708,718 B2
(45) Date of Patent: Apr. 29, 2014

(54) ELECTRICAL CONNECTOR WITH GROUNDING CONTACT HAVING FORKED SOLDERING BRANCHES

(71) Applicant: Shenzhen Luxshare Precision Industry Co., Ltd., Shenzhen (CN)

(72) Inventors: Bin Li, Kunshan (CN); Wei-Ya Cheng, Kunshan (CN)

(73) Assignee: Luxshare Precision Industry Co., Ltd., Shenzhen, Guangdong Province (CN)

( * ) Notice: Subject to any disclaimer, the term of this patent is extended or adjusted under 35 U.S.C. 154(b) by 0 days.

(21) Appl. No.: 13/662,474

(22) Filed: Oct. 27, 2012

(65) Prior Publication Data

US 2013/0109238 A1 May 2, 2013

(30) Foreign Application Priority Data

Oct. 27, 2011 (CN) ..... 2011 2 0416251 U

(51) Int. Cl.
*H01R 13/648* (2006.01)

(52) U.S. Cl.
USPC ..... 439/108; 439/497; 439/660

(58) Field of Classification Search
USPC ..... 439/497, 660, 108
See application file for complete search history.

(56) References Cited

U.S. PATENT DOCUMENTS

| | | | | |
|---|---|---|---|---|
| 6,053,776 | A * | 4/2000 | Bricaud et al. | 439/630 |
| 6,305,960 | B1 * | 10/2001 | Fan | 439/188 |
| 6,799,983 | B2 * | 10/2004 | Pavlovic et al. | 439/181 |
| 6,875,048 | B2 * | 4/2005 | Lee | 439/497 |
| 7,438,576 | B2 * | 10/2008 | Sakakura | 439/206 |
| 7,972,151 | B2 * | 7/2011 | He et al. | 439/108 |
| 8,292,655 | B1 * | 10/2012 | Ling et al. | 439/497 |
| 2004/0266255 | A1 * | 12/2004 | Lee | 439/497 |
| 2005/0176305 | A1 * | 8/2005 | Wu | 439/660 |
| 2009/0130906 | A1 * | 5/2009 | Tsao et al. | 439/626 |
| 2011/0269341 | A1 * | 11/2011 | He et al. | 439/607.01 |
| 2013/0109238 | A1 * | 5/2013 | Li et al. | 439/625 |
| 2013/0115822 | A1 * | 5/2013 | Pan et al. | 439/660 |

* cited by examiner

*Primary Examiner* — James Harvey
(74) *Attorney, Agent, or Firm* — Cheng-Ju Chiang

(57) ABSTRACT

A cable connector compatible to type-A USB 3.0 standard includes a number of contacts divided into a first contact group and a second contact group. The first contact group is compatible to USB 2.0 standard. The second contact group includes a number of second contacts having a first pair of high-speed differential signal contacts, a second pair of high-speed differential signal contacts and a grounding contact disposed between the first pair and the second pair of high-speed differential signal contacts. The second soldering section of the grounding contact is of a forked manner and includes at least a first branch and a second branch. As a result, it is more effective to solder the second soldering section of the grounding contact with a cable without any manual alignment work.

16 Claims, 6 Drawing Sheets

ELECTRICAL CONNECTOR WITH GROUNDING CONTACT HAVING FORKED SOLDERING BRANCHES

BACKGROUND OF THE INVENTION

1. Field of the Invention

The present invention relates to an electrical connector, and more particularly, to a cable connector with a grounding contact which has forked soldering branches for improving soldering efficiency of the cable connector in mass production.

2. Description of Related Art

On November 2008, a new generation of USB 3.0 (super high-speed USB) enacted by industry-leading corporations including Intel, Microsoft, HP, TI, NEC and ST-NXP etc. was released. The USB 3.0 standard provides transmission speed 10 times quicker than the USB 2.0 standard and has higher energy efficiency so that the USB 3.0 standard can be applied in PC peripheral devices and consumer electronics.

The development of the USB (Universal Serial Bus) standards is as follows: the first version, known as USB 1.0, was released on 1996 and its transmission speed is only up to 1.5 Mb/s; two years later, the USB 1.0 was upgraded to USB 1.1 with its transmission speed to 12 Mb/s; on April 2000, current widely used USB 2.0 was released with its transmission speed up to 480 Mb/s; however, the speed of USB 2.0 cannot meet the requirements of actual use anymore and under this condition, the USB 3.0 was pushed forward and the maximum transmission speed thereof is up to 5.0 Gb/s.

The USB 3.0 standard (or specification) defines type-A receptacle and plug and the type-A USB 3.0 plug is compatible to USB 2.0 receptacle. Comparing with the preceding generation of type-A USB 2.0 plug, the type-A USB 3.0 plug newly adds five elastic contacts and totally has nine contacts. The newly added five contacts include two pairs of high-speed differential signal contacts and a grounding contact therebetween. The afore-mentioned nine contacts extend to a rear end of an insulative housing for being soldered to cables. However, since the space of the insulative housing is very limited, if soldering sections of the nine contacts are of the same configuration, such soldering sections are very intensive. Under this condition, during the soldering process, manual work of aligning such soldering section, especially the middle one, with the cables is usually needed. Such manual work might warp the cables and is harmful to improve product efficiency and reduce cost.

Hence, an electrical connector with improved soldering sections for improving soldering efficiency is desired.

BRIEF SUMMARY OF THE INVENTION

The present invention provides a cable connector compatible to type-A USB 3.0 standard. The cable connector includes an insulative housing, a plurality of contacts retained in the insulative housing and a metallic shell enclosing the insulative housing. The insulative housing includes a tongue plate which defines a mating portion enclosed by the metallic shell. The plurality of contacts are divided into a first contact group and a second contact group. The first contact group includes a plurality of first contacts each of which comprises a flat first contacting section extending onto the mating portion, a first retaining section fixed in the insulative housing and a first soldering section for being connected to a cable. The second contact group includes a plurality of second contacts each of which comprises a resilient second contacting section protruding upwardly beyond the first contacting sections, a second retaining section fixed in the insulative housing and a second soldering section for being connected to a cable. The second contacts includes a first pair of high-speed differential signal contacts, a second pair of high-speed differential signal contacts and a grounding contact disposed between the first pair and the second pair of high-speed differential signal contacts. The second soldering section of the grounding contact is of a forked manner and includes at least a first branch and a second branch. As a result, it is more effective to solder the second soldering section of the grounding contact with a cable without any manual alignment work.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The components in the drawing are not necessarily drawn to scale, the emphasis instead being placed upon clearly illustrating the principles of the described embodiments. In the drawings, reference numerals designate corresponding parts throughout various views, and all the views are schematic.

DETAILED DESCRIPTION OF THE PREFERRED EMBODIMENT

Figure 1:
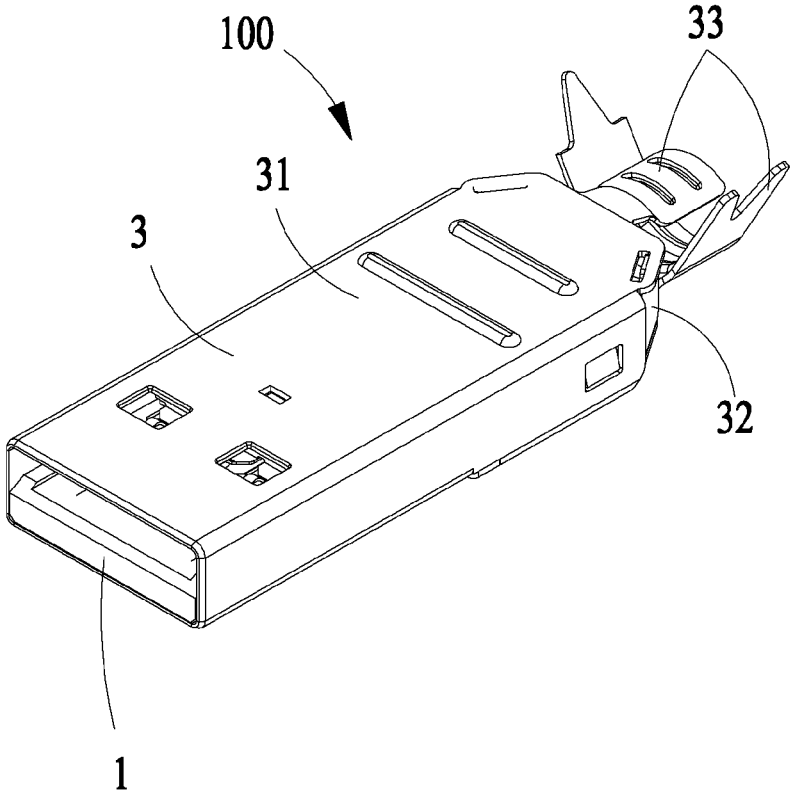
FIG. 1 is a perspective view of an electrical connector in accordance with an illustrated embodiment of the present invention.
Figure 2:
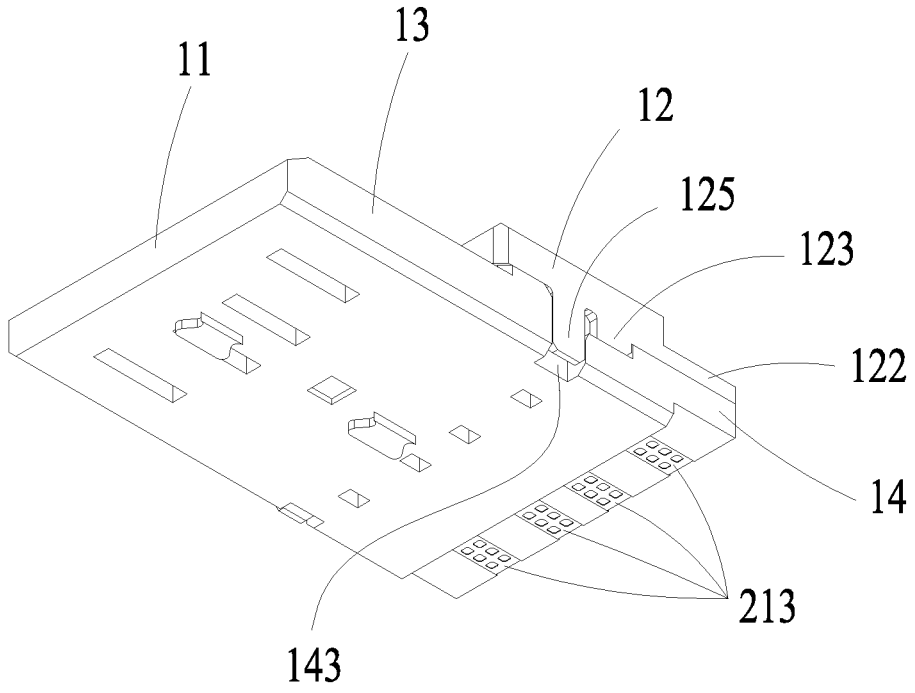
FIG. 2 is a partly perspective view of the electrical connector as shown in FIG. 1 with a metallic shell removed therefrom.

Reference will now be made to the drawing figures to describe the embodiments of the present invention in detail. In the following description, the same drawing reference numerals are used for the same elements in different drawings.

Referring to FIGS. 1 to 5, the present invention discloses an electrical connector compatible to type-A USB 3.0 standard. According to the illustrated embodiment of the present invention, the electrical connector is a cable connector 100 and includes an insulative housing 1, a plurality of contacts 2 retained in the insulative housing 1 and a metallic shell 3 fixed to and enclosing the insulative housing 1.

Referring to FIGS. 2 to 5, the insulative housing 1 includes a tongue plate 11 and an insulative block 12 attached to the tongue plate 11. The tongue plate 11 comprises a front mating portion 13 for mating with a mateable receptacle connector (not shown) and a rear base portion 14 extending backwardly from the mating portion 13. The mating portion 13 is rectangular shaped and includes a top mating surface 131, a bottom surface 132 opposite to the mating surface 131 and a plurality of slots 133 extending upwardly through the mating surface 131. The base portion 14 includes a rectangular recess 141, a pair of round holes 142 formed in the recess 141, a pair of notches 143 on lateral edges thereof and a pair of stepped walls 144 exposed to the notches 143.

The insulative block 12 includes a main body 121 and a thin plate 122 extending backwardly from the main body 121. The main body 121 includes a rectangular protrusion 123 with a pair of cylinder posts 124 thereon, and a pair of locking arms 125 each of which includes a hook 126 at a distal end thereof.

Figure 3:
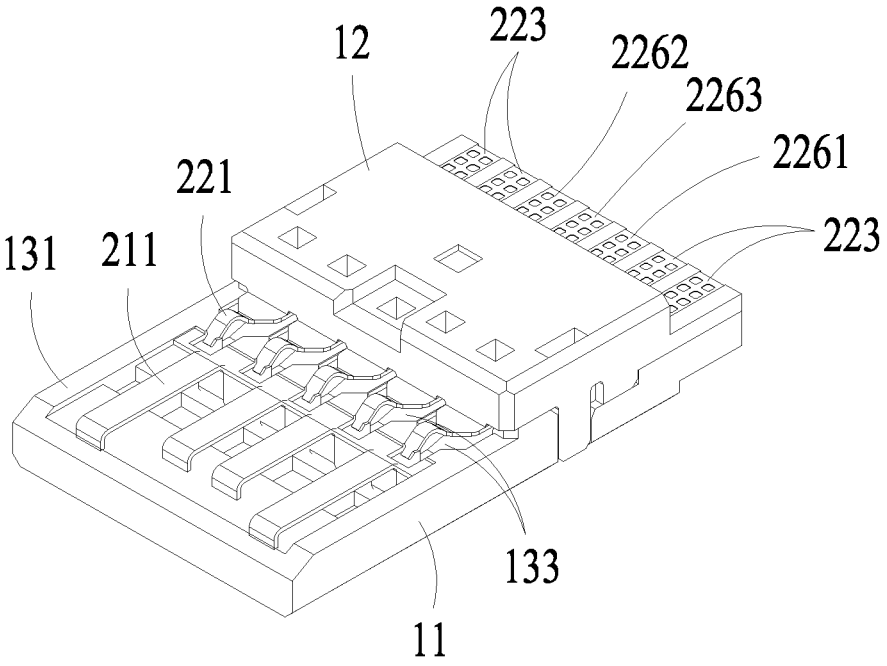
FIG. 3 is another partly perspective view of the electrical connector as shown in FIG. 2.

Referring to FIGS. 2 to 5, the contacts 2 are divided into a first contact group and a second contact group. The first contact group includes a plurality of first contacts 21 compatible to USB 2.0 standard. Each first contact 21 includes a flat/non-elastic first contacting section 211 extending onto the mating surface 131 of the mating portion 13 (as shown in FIG. 3), a first retaining section 212 fixed in the tongue plate 11 of the insulative housing 1 and a first soldering section 213 for being connected to a cable (not shown). According to the illustrated embodiment of the present invention, the first contacts 21 are insert-molded with the tongue plate 11. The first retaining sections 212 are lower than the first contacting sections 211 and the first soldering sections 213 so that, on one hand, the first retaining sections 212 can be more stably embedded in the tongue plate 11; on the other hand, the first contacting sections 211 can be exposed on the mating surface 131 for mating with the mateable receptacle connector and the first soldering sections 213 can be exposed on a bottom surface of the base portion 14 for being connected to cables. Besides, each first contact 21 includes a front tab 214 bent downwardly from a front edge of the first contacting section 212. The front tabs 214 are embedded in the mating portion 13 for not only securely retaining the first contacting sections 211 onto the mating surface 131 of the mating portion 13 but also preventing the first contacting sections 211 from upwardly buckling during insertion into the mateable receptacle connector.

Referring to FIGS. 2 to 6, the second contact group includes a plurality of second contacts 22. The first contacts 21 and the second contacts 22 jointly are compatible to USB 3.0 standard. From a structural viewpoint, each second contact 22 includes a resilient/deformable second contacting section 221, a second retaining section 222 fixed in the insulative block 12 of the insulative housing 1 and a second soldering section 223 for being connected to a cable. From a functional viewpoint, the second contacts 22 includes a first pair of high-speed differential signal contacts 224, a second pair of high-speed differential signal contacts 225 and a grounding contact 226 disposed between the first pair and the second pair of high-speed differential signal contacts 224, 225.

As shown in FIG. 3, the resilient second contacting sections 221 protrude upwardly beyond the first contacting sections 211 and the mating surface 131 of the mating portion 13, and can be deformable in corresponding slots 133 during connector mating. The first contacting sections 211 are positioned at the front of the resilient second contacting sections 221. According to the illustrated embodiment of the present invention, the second contacts 22 are insert-molded with the insulative block 12 with the second soldering sections 223 exposed on a top surface of the thin plate 122. The first soldering sections 213 and the second soldering sections 223 are located at different horizontal planes, respectively, so that cables can be easily separated to be soldered to the first and the second soldering sections 213, 223.

Figure 4:
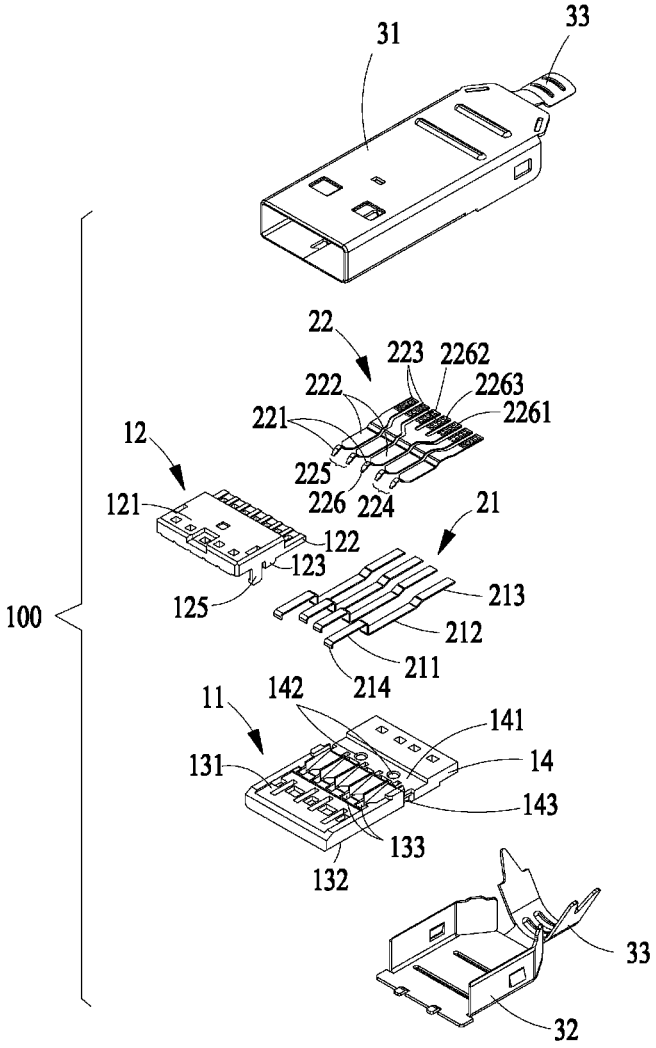
FIG. 4 is an exploded view of the electrical connector as shown in FIG. 1.
Figure 5:
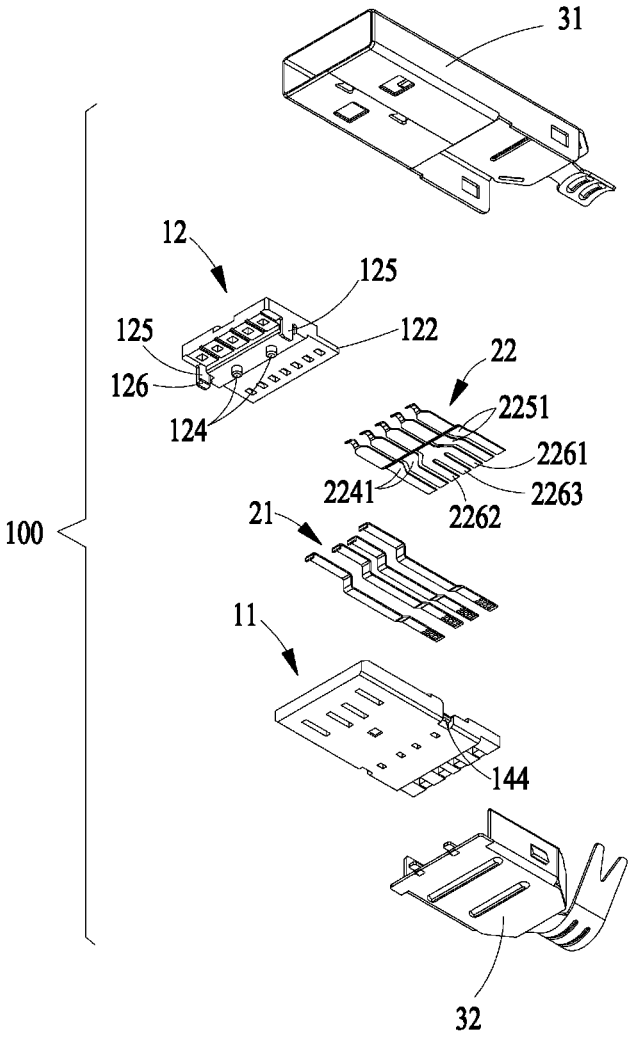
FIG. 5 is another exploded view of the electrical connector similar to FIG. 4 while taken from a different aspect.
Figure 6:
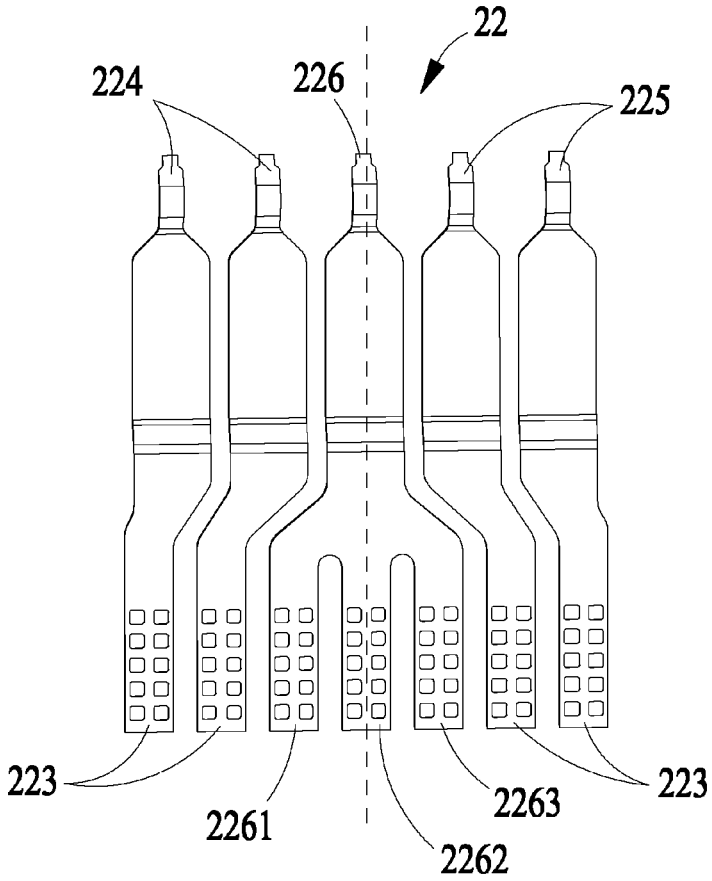
FIG. 6 is a top view of second contacts of the electrical connector.

As shown in FIGS. 4 to 6, regarding the grounding contact 226, the second retaining section 222 thereof is wider than the resilient second contacting section 221 while is narrower than the second soldering section 223. Under such arrangement, the second retaining section 222 can be provided with reasonable area so as to be stably fixed in the insulative block 12, and the widest second soldering section 223 can enlarge the whole area of the grounding contact 226 for achieving better grounding/shielding effect. Besides, each second soldering section 223 of the first pair of high-speed differential signal contacts 224 comprises a first offset portion 2241 inclined to a first side of the second soldering section 223 of the grounding contact 226, and each second soldering section 223 of the second pair of high-speed differential signal contacts 225 comprises a second offset portion 2251 inclined to a second side of the second soldering section 223 of the grounding contact 226 opposite to the first side. Under such inclined arrangement of the first pair and the second pair of high-speed differential signal contacts 224, 225, much larger space can be provided for arranging the wide second soldering section 223 of the grounding contact 226.

The second soldering section 223 of the grounding contact 226 is of a forked manner and includes a first branch 2261 for connecting with a grounding wire of the cable, a second branch 2262 for connecting with a grounding wire of the cable and a third branch 2263 between the first branch 2261 and the second branch 2262. The third branch 2263 is adapted for connecting with a metallic shielding braid layer of the cable. The first branch 2261 and the second branch 2262 are symmetrically located at opposite sides of the third branch 2263 under condition that front ends of the first branch 2261, the second branch 2262 and the third branch 2263 are connected together while rear ends of the first branch 2261, the second branch 2262 and the third branch 2263 are separated from each other. Regarding the grounding contact 226, center line axis of the second retaining section 222, the resilient second contacting section 221 and the second soldering section 223 are aligned together and define a single straight axis along a front-to-back direction. The first branch 2261 and the second branch 2262 are symmetrical to each other along one of the center line axis. The first branch 2261, the second branch 2262 and the third branch 2263 of the second soldering section 223 of the grounding contact 226 as well as the second soldering sections 223 of the first pair and the second pair of high-speed differential signal contacts 224, 225 have the same widths and are averagely arranged along a width direction of the insulative housing 1.

Besides, a space between the second soldering sections 223 of the first pair and the second pair of high-speed differential signal contacts 224, 225 is larger than that between the resilient second contacting sections 221 of the first pair and the second pair of high-speed differential signal contacts 224, 225. With such forked second soldering section 223 of the grounding contact 226, on one hand, high-frequency signal transmission can be improved; on the other hand, it is much easier to solder the cable with the grounding contact 226 so as to improve soldering efficiency in mass production. Understandably, more outside, the second soldering sections 223 are much easier to get soldered because peripheral space can be used. That is to say, since the second soldering section 223 of the grounding contact 226 is located at the middle, it is difficult for soldering. According to the illustrated embodiment of the present invention, with such forked second soldering section 223 of the grounding contact 226, it is effective to solve the problem of warping cables.

Referring to FIGS. 2 to 5, any of the second soldering sections 223 of the first pair and the second pair of high-speed differential signal contacts 224, 225 is narrower than any of the first soldering sections 213. However, the second soldering section 223 of the grounding contact 226 is wider than any of the first soldering sections 213. From an integral observation, the area of all the second soldering sections 223 is larger than that of all the first soldering sections 213 along the width direction of the insulative housing 1.

Referring to FIGS. 1, 4 and 5, the metallic shell 3 encloses the mating portion 13 and includes a top shell 31 and a bottom shell 32 locking with the top shell 31. Each of the top shell 31 and the bottom shell 32 includes a clip 33 for regulating/fixing the cables.

In assembling, the tongue plate 11 with the first contacts 21 and the insulative block 12 with the second contacts 22 are attached with each other. The protrusion 123 of the insulative block 12 is received in the recess 141 of the tongue plate 11. The pair of cylinder posts 124 are inserted in the pair of round holes 142 for positioning The pair of locking arms 125 are mateable with the notches 143 along a top-to-bottom direction with the hooks 126 lockable with corresponding stepped walls 144 for preventing the insulative block 12 from being separated from the tongue plate 11 along a bottom-to-top direction. Ultimately, the top shell 31 and the bottom shell 32 are assembled to the insulative housing 1.

It is to be understood, however, that even though numerous characteristics and advantages of preferred and exemplary embodiments have been set out in the foregoing description, together with details of the structures and functions of the embodiments, the disclosure is illustrative only; and that changes may be made in detail within the principles of present disclosure to the full extent indicated by the broadest general meaning of the terms in which the appended claims are expressed.

What is claimed is:

1. A cable connector compatible to type-A Universal Serial Bus (USB) 3.0 standard, comprising:

an insulative housing comprising a tongue plate defining a mating portion;

a plurality of contacts retained in the insulative housing and divided into a first contact group and a second contact group, the first contact group comprising a plurality of first contacts each of which comprises a flat first contacting section extending onto the mating portion, a first retaining section fixed in the insulative housing and a first soldering section for being connected to a cable, the second contact group comprising a plurality of second contacts each of which comprises a resilient second contacting section protruding upwardly beyond the first contacting sections, a second retaining section fixed in the insulative housing and a second soldering section for being connected to a cable, the second contacts comprising a first pair of high-speed differential signal contacts, a second pair of high-speed differential signal contacts and a grounding contact disposed between the first pair and the second pair of high-speed differential signal contacts; and a metallic shell enclosing the mating portion; wherein the second soldering section of the grounding contact is of a forked manner and comprises at least a first branch and a second branch; and wherein front ends of the first branch and the second branch are connected together while rear ends of the first branch and the second branch are separated from each other; and wherein regarding the grounding contact, the second retaining section thereof is wider than the resilient second contacting section while is narrower than the second soldering section; and wherein regarding the grounding contact, center line axis of the second retaining section, the resilient second contacting section and the second soldering section are aligned together and define a single straight axis along a front-to-back direction, and the first branch and the second branch are symmetrical to each other along one of the center line axis.

2. An electrical connector comprising:

an insulative housing comprising a tongue plate and an insulative block fixed to the tongue plate, the tongue plate defining a mating portion;

a plurality of first contacts retained in the tongue plate, each first contact comprising a flat first contacting section exposed on the mating portion, a first retaining section embedded in the tongue plate and a first soldering section extending from the first retaining section;

a plurality of second contacts retained in the insulative block, each second contact comprising a resilient second contacting section protruding upwardly beyond the first contacting sections, a second retaining section fixed in the insulative block and a second soldering section extending from the second retaining section, the second contacts comprising a first pair of high-speed differential signal contacts, a second pair of high-speed differential signal contacts and a grounding contact disposed between the first pair and the second pair of high-speed differential signal contacts; and a metallic shell enclosing the mating portion; wherein the second soldering section of the grounding contact is forked and comprises a first branch for connecting with a grounding wire of a cable, a second branch for connecting with a grounding wire of the cable and a third branch for connecting with a metallic shielding braid layer of the cable in condition that the first branch and the second branch are symmetrical to each other along the third branch.

3. The electrical connector as claimed in claim 2, wherein regarding the grounding contact, the second retaining section thereof is wider than the resilient second contacting section while is narrower than the second soldering section.

4. The electrical connector as claimed in claim 2, wherein the first branch, the second branch and the third branch of the second soldering section of the grounding contact as well as the second soldering sections of the first pair and the second pair of high-speed differential signal contacts have the same widths and are averagely arranged along a width direction of the insulative housing.

5. The cable connector as claimed in claim 1, wherein the second soldering section of the grounding contact comprises a third branch between the first branch and the second branch, the first branch and the second branch being symmetrically located at opposite sides of the third branch under condition that front ends of the first branch, the second branch and the third branch are connected together while rear ends of the first branch, the second branch and the third branch are separated from each other.

6. The cable connector as claimed in claim 5, wherein the first branch, the second branch and the third branch of the second soldering section of the grounding contact as well as the second soldering sections of the first pair and the second pair of high-speed differential signal contacts have the same widths and are averagely arranged along a width direction of the insulative housing.

7. The cable connector as claimed in claim 1, wherein each second soldering section of the first pair of high-speed differential signal contacts comprises a first offset portion inclined to a first side of the second soldering section of the grounding contact, and each second soldering section of the second pair of high-speed differential signal contacts comprises a second offset portion inclined to a second side of the second soldering section of the grounding contact opposite to the first side.

8. The cable connector as claimed in claim 1, wherein the flat first contacting sections are positioned at the front of the resilient second contacting sections, and the first soldering sections and the second soldering sections are located at different horizontal planes, respectively.

9. The cable connector as claimed in claim 1, wherein a space between the second soldering sections of the first pair of high-speed differential signal contacts is smaller than that between the resilient second contacting sections of the first pair of high-speed differential signal contacts, and a space between the second soldering sections of the second pair of high-speed differential signal contacts is smaller than that between the resilient second contacting sections of the second pair of high-speed differential signal contacts.

10. The cable connector as claimed in claim 1, wherein any of the second soldering sections of the first pair and the second pair of high-speed differential signal contacts is narrower than any of the first soldering sections.

11. The electrical connector as claimed in claim 2, wherein the tongue plate comprises a pair of notches on lateral edges thereof and a pair of stepped walls exposed to the notches, the insulative block comprising a pair of locking arms each of which comprises a hook to lock with corresponding stepped wall so as to prevent the insulative block from being separated from the tongue plate along a bottom-to-top direction.

12. A cable connector compatible to type-A Universal Serial Bus (USB) 3.0 standard, comprising:

an insulative housing comprising a tongue plate defining a mating portion;

a plurality of contacts retained in the insulative housing and divided into a first contact group and a second contact group, the first contact group comprising a plurality of first contacts each of which comprises a flat first contacting section extending onto the mating portion, a first retaining section fixed in the insulative housing and a first soldering section for being connected to a cable, the second contact group comprising a plurality of second contacts each of which comprises a resilient second contacting section protruding upwardly beyond the first contacting sections, a second retaining section fixed in the insulative housing and a second soldering section for being connected to a cable, the second contacts comprising a first pair of high-speed differential signal contacts, a second pair of high-speed differential signal contacts and a grounding contact disposed between the first pair and the second pair of high-speed differential signal contacts; and a metallic shell enclosing the mating portion; wherein the second soldering section of the grounding contact is of a forked manner and comprises at least a first branch and a second branch; and wherein the first contacts are insert-molded with the tongue plate, the insulative housing comprising an insulative block with the second contacts embedded therein, the insulative block being locked with the tongue plate along a top-to-bottom direction; and wherein the tongue plate comprises a pair of notches on lateral edges thereof and a pair of stepped walls exposed to the notches, the insulative block comprising a pair of locking arms each of which comprises a hook to lock with corresponding stepped wall so as to prevent the insulative block from being separated from the tongue plate along a bottom-to-top direction.

13. The cable connector as claimed in claim 12, wherein the tongue plate defines a pair of holes and the insulative block comprises a pair of cylinder posts inserted in the holes for positioning.

14. The cable connector as claimed in claim 13, wherein the tongue plate defines a recess with the pair of holes therein and the insulative block comprises a protrusion with the pair of cylinder posts thereon, the protrusion being received in the recess.

15. The electrical connector as claimed in claim 2, wherein each second soldering section of the first pair of high-speed differential signal contacts comprises a first offset portion inclined to a first side of the second soldering section of the grounding contact, and each second soldering section of the second pair of high-speed differential signal contacts comprises a second offset portion inclined to a second side of the second soldering section of the grounding contact opposite to the first side.

16. The electrical connector as claimed in claim 2, wherein front ends of the first branch, the second branch and the third branch are connected together while rear ends of the first branch, the second branch and the third branch are separated from each other.

* * * * *